US011999387B2

(12) United States Patent
Zhang et al.

(10) Patent No.: US 11,999,387 B2
(45) Date of Patent: Jun. 4, 2024

(54) HEAT DISSIPATION SYSTEM FOR HIGH-SPEED TRAIN RUNNING IN LOW-VACUUM TUBE

(71) Applicants: HEFEI GENERAL MACHINERY RESEARCH INSTITUTE CO., LTD, Hefei (CN); HEFEI GENERAL ENVIRONMENTAL CONTROL TECHNOLOGY CO., LTD, Hefei (CN); HIWING TECHNOLOGY ACADEMY OF CASIC, Beijing (CN)

(72) Inventors: Xiuping Zhang, Hefei (CN); Panpan Zhao, Hefei (CN); Junfeng Wu, Hefei (CN); Ru Zhang, Hefei (CN); Xiaoming Kong, Hefei (CN); Shuangqing Xu, Hefei (CN); Dao Zhou, Hefei (CN); Xudong Yuan, Hefei (CN); Kai Mao, Hefei (CN); Na Zhang, Hefei (CN); Ming Zhao, Hefei (CN); Shaowei Li, Hefei (CN); Jinglong Bo, Hefei (CN)

(73) Assignees: HEFEI GENERAL MACHINERY RESEARCH INSTITUTE CO., LTD, Hefei (CN); HEFEI GENERAL ENVIRONMENTAL CONTROL TECHNOLOGY CO., LTD, Hefei (CN); HIWING TECHNOLOGY ACADEMY OF CASIC, Beijing (CN)

( * ) Notice: Subject to any disclaimer, the term of this patent is extended or adjusted under 35 U.S.C. 154(b) by 364 days.

(21) Appl. No.: 17/615,528

(22) PCT Filed: Feb. 25, 2021

(86) PCT No.: PCT/CN2021/077768
§ 371 (c)(1),
(2) Date: Nov. 30, 2021

(87) PCT Pub. No.: WO2021/175140
PCT Pub. Date: Sep. 10, 2021

(65) Prior Publication Data

US 2022/0315066 A1 Oct. 6, 2022

(30) Foreign Application Priority Data

Mar. 5, 2020 (CN) ..... 202010146656.X
Aug. 14, 2020 (CN) ..... 202010820687.9

(51) Int. Cl.
*B61D 27/00* (2006.01)
*B61B 13/08* (2006.01)
*B61B 13/10* (2006.01)

(52) U.S. Cl.
CPC ..... *B61D 27/0072* (2013.01); *B61B 13/08* (2013.01); *B61B 13/10* (2013.01)

(58) Field of Classification Search
CPC ..... B61D 27/0072; B61B 13/08; B61B 13/10
See application file for complete search history.

(56) References Cited

U.S. PATENT DOCUMENTS 3,768,417 A * 10/1973 Thornton ..... B61B 15/00 104/285
5,666,883 A * 9/1997 Kuznetsov ..... B60L 13/08 104/285

(Continued)

FOREIGN PATENT DOCUMENTS

CN 102079310 A 6/2011
CN 105620495 A 6/2016

(Continued)

*Primary Examiner* — Marc E Norman
(74) *Attorney, Agent, or Firm* — Bayramoglu Law Offices LLC

(57) ABSTRACT

A heat dissipation system for a high-speed train running in a low-vacuum tube is provided. Component groups that (Continued)

provide power and resistance for the movement and stop of a train are provided at a periphery, close to the train, in a low-vacuum tube. The component group is provided with a group A cooling assembly. The group A cooling assembly includes a group A cooling-type heat exchanger and/or a group A nozzle assembly attached to the back of the component group. Since the friction between the train running at high speed and the air in the low-vacuum tube and the operation of the key equipment in the low-vacuum tube will generate a lot of heat, the group A cooling assembly in the component group in the low-vacuum tube exchanges the heat with the air in the low-vacuum tube.

9 Claims, 8 Drawing Sheets

(56) References Cited

U.S. PATENT DOCUMENTS

| | | | | |
|---|---|---|---|---|
| 5,950,543 | A * | 9/1999 | Oster | B61B 13/10<br>104/130.05 |
| 2014/0261055 | A1* | 9/2014 | Oster | E01B 25/30<br>104/138.1 |
| 2018/0281820 | A1 | 10/2018 | Grip et al. | |
| 2020/0239036 | A1* | 7/2020 | Lee | F16F 15/02 |

FOREIGN PATENT DOCUMENTS

| | | | |
|---|---|---|---|
| CN | 108513498 | A | 9/2018 |
| CN | 110696843 | A | 1/2020 |
| CN | 111409650 | A | 7/2020 |
| CN | 112026795 | A | 12/2020 |

* cited by examiner

HEAT DISSIPATION SYSTEM FOR HIGH-SPEED TRAIN RUNNING IN LOW-VACUUM TUBE

CROSS REFERENCE TO THE RELATED APPLICATIONS

This application is the national stage entry of International Application No. PCT/CN2021/077768, filed on Feb. 25, 2021, which is based upon and claims priority to Chinese Patent Application No. 202010146656.X filed on Mar. 5, 2020, and Chinese Patent Application No. 202010820687.9 filed on Aug. 14, 2020, the entire contents of which are incorporated herein by reference.

TECHNICAL FIELD

The present disclosure relates to the technical field of thermal management of ultra-high-speed magnetic levitation (maglev) trains in the low-vacuum tube, in particular to a heat dissipation system for a high-speed train running in a low-vacuum tube.

BACKGROUND

China's railway construction and railway transportation are rapidly developing. After several expedited advancements, the transportation capacity of railway traffic has been greatly improved. However, with the rapid and stable development of China's national economy, the requirement for railway transportation is getting increasingly higher. It is an important trend and inevitable choice for future ground transportation to develop high-speed, low-noise, low-carbon and environmentally friendly transportation.

At present, the fastest running speed of the high-speed train in China has reached 350 km/h. In order to further increase the speed of trains, it is necessary to overcome the dense atmosphere on the ground, which is the biggest bottleneck hindering the development of ground high-speed transportation systems. In the magnetic levitation (maglev) technology, low-pressure tubes or low-vacuum tubes can be added along the line to avoid the impact of airflow on the high-speed trains, so as to develop a low-vacuum tube transportation system or vacuum tube system, which is an important development direction for super-high-speed passenger traffic on the ground in the future.

The high-speed running of trains in the low-vacuum tube will cause the temperature of the tube to keep going up, which will affect the normal operation and service life of the equipment. Moreover, the rising temperature will adversely affect the safe operation of the low-vacuum tube transportation and bring safety hazards. Therefore, the reliability of the lineside heat dissipation system when the high-speed train runs in the low-vacuum tube at high speed will directly affect the safety and economy of the low-vacuum tube transportation system.

A small amount of air in the low-vacuum tube will greatly reduce the rate of heat conduction and convection. Meanwhile, the high-speed train will push the airflow at the head of the train, forming a denser airflow locally.

SUMMARY

In order to realize the lineside heat dissipation of the high-speed train running in the low-vacuum tube, the present disclosure provides a heat dissipation system for a high-speed train running in a low-vacuum tube. The present disclosure adopts the following technical solutions.

A heat dissipation system for a high-speed train running in a low-vacuum tube, where component groups that provide power and resistance for the movement and stop of a train are provided at a periphery, close to the train, in a low-vacuum tube; the component group is provided with a group A cooling assembly; the group A cooling assembly includes a group A cooling-type heat exchanger and/or a group A nozzle assembly attached to the back of the component group.

Preferably, the low-vacuum tube may further include cavities respectively located at a periphery of the train; the cavities may extend in parallel along an advancing direction of the train; the component groups that provide power and resistance for the movement and stop of the train respectively may be provided in the cavity close to the periphery of the train; the cavity may be provided with air vents along a length direction; when the train moves forward, air inside the low-vacuum tube may be pressed to circulate in the cavity and the tube; the circulating air may take away heat generated when the train moves.

Preferably, the low-vacuum tube may be provided with a group B cooling assembly; the group B cooling assembly may include a group B cooling-type heat exchanger and/or a group B nozzle assembly.

Preferably, when the cooling assembly includes a cooling-type heat exchanger of the corresponding group, the cooling assembly may further include a cooling tower for providing a cold source for the cooling-type heat exchanger; a transition unit may be further provided between the cooling tower and the cooling-type heat exchanger; the cooling tower and the transition unit may be provided outside the low-vacuum tube.

Preferably, the transition unit may include a plate-type heat exchanger or a refrigeration unit; a heat exchange loop may be formed between the plate-type heat exchanger or the refrigeration unit and the cooling tower; a heat exchange loop may be formed between the plate-type heat exchanger or the refrigeration unit and the cooling-type heat exchanger.

Preferably, the transition unit may further include a constant-temperature water tank; the constant-temperature water tank may be provided between the plate-type heat exchanger or the refrigeration unit and the cooling-type heat exchanger.

Preferably, when the cooling assembly includes a nozzle assembly of the corresponding group, the cooling assembly may further include a constant-temperature water tank, an automatic water replenishment valve, a seventh on-off valve and a seventh pump body; the constant-temperature water tank may be connected to an external water source through the automatic water replenishment valve; the constant-temperature water tank may include an output end for supplying water to the nozzle assembly by using the seventh on-off valve and the seventh pump body in sequence.

Preferably, the cavities may include a first cavity provided at the periphery of the train and along a line in the low-vacuum tube; a component group providing power for the train may be provided in the first cavity close to the periphery of the train.

Preferably, an upper end surface of the first cavity may be provided with a plurality of first air vents along the advancing direction of the train.

Preferably, the cavities may include a second cavity provided at the bottom of the train and along the line in the low-vacuum tube; an upper end surface of the second cavity may be a brake component; the brake component may be provided with a plurality of second air vents along the advancing direction of the train.

The present disclosure has the following advantages:

(1) Since the friction between the train running at high speed and the air in the low-vacuum tube and the operation of the key equipment in the low-vacuum tube will generate a lot of heat, in addition to that generated in the tube due to other factors, the present disclosure provides the group A cooling assembly in the component group in the low-vacuum tube to exchange the heat with the air in the low-vacuum tube, thereby achieving a cooling effect.

(2) The present disclosure provides several schemes for the cooling assembly. Scheme 1 is to use a cooling-type heat exchanger to cool the component group, Scheme 2 is to use a nozzle assembly to spray a liquid for cooling, and Scheme 3 is to combine the cooling-type heat exchanger and the nozzle assembly for cooling. These schemes can achieve the most cost-effective cooling mode according to different needs.

(3) The present disclosure provides a variety of modes for cooling by using the cooling-type heat exchanger. 1. The heat is exchanged between the cooling tower and the plate-type heat exchanger, and then the heat is exchanged between the plate-type heat exchanger and the cooling-type heat exchanger. 2. The heat is exchanged between the cooling tower and the refrigeration unit, and then the heat is exchanged between the refrigeration unit and a plurality of cooling-type heat exchangers. 3. In Schemes 2 and 3, a constant-temperature water tank is provided between the plate-type heat exchanger, the refrigeration unit and the cooling-type heat exchanger, which improves the cooling effect of the cooling-type heat exchanger. 4. The refrigeration unit, the plate-type heat exchanger and the constant-temperature water tank are provided with different on-off valves to select different working modes.

(4) The present disclosure also provides a variety of modes for cooling by using the nozzle assembly.

(5) The cooling tower and the transition unit are provided outside the low-vacuum tube to prevent the cooling tower and the transition unit from affecting the air flow in the low-vacuum tube.

(6) The low-vacuum tube accumulates a large amount of heat generated by air compression and air friction during the working process of the component groups that provide power and resistance for the movement and stop of the train respectively. The present disclosure provides cavities with air vents to guide the air at the front of a train head to flow from the air vents of the cavities to the rear of a train body to form air flow circulation. The heat generated when the train is running is taken away by the cooling assembly to ensure the safe and reliable operation of the high-speed train running in the low-vacuum tube.

(7) The first cavity is used to control the temperature of the component groups that provide power and resistance for the train. The air enters the first cavity from the first air vent close to the train head, and flows from the component group at the train head to the component group at the rear of the train. Finally, the air flows out through the air vent at the rear of the train body.

(8) In this scheme, in order to increase the air intake and reduce the resistance of the circulating air, a plurality of first air vents are further provided on the upper end surface of the first cavity. In this way, the amount of circulating air is increased, thereby increasing the cooling efficiency.

(9) The second cavity is used to cool the brake component. When the train moves forward, the air in the low-vacuum tube is pressed to enter the second cavity from the second air vent close to the train head. The flowing air flows under the brake component, thereby taking away the heat generated by the brake component.

(10) The present disclosure also provides a cooling-type heat exchanger and/or a nozzle assembly in the cavity to increase the heat exchange area of the air.

REFERENCE NUMERALS

Figure 1:
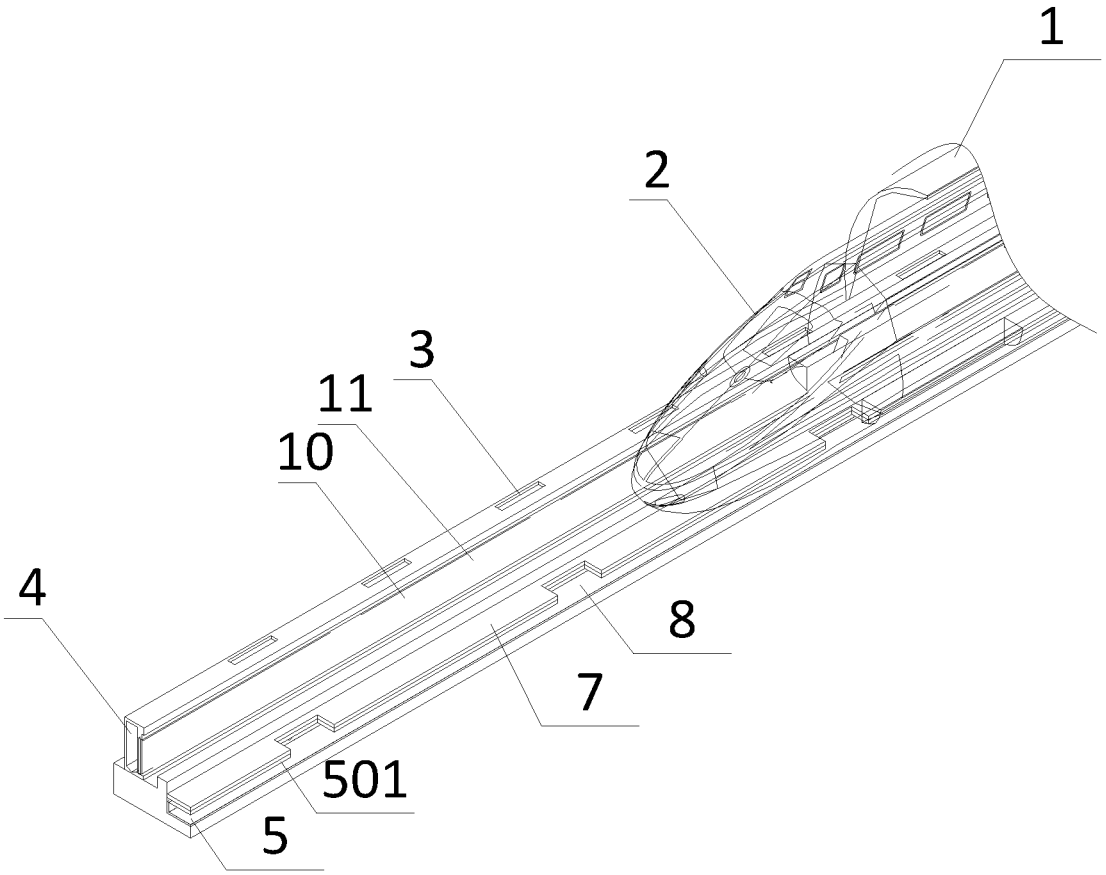
FIG. 1 is a cross-sectional view of a train running in a low-vacuum tube.

1. low-vacuum tube;
101. first low-vacuum tube; 102. second low-vacuum tube; 103. partition;
2. train; 3. first air vent; 4. first cavity;
5. second cavity; 6. second cooling-type heat exchanger; 7. brake component; 8. second air vent;
9. first cooling-type heat exchanger; 10. component group providing power to train; 12. communicating pipe;
21. cooling tower; 22. first pump body; 23. plate-type heat exchanger; 24. second pump body;
25. refrigeration unit; 26. third pump body; 27. fourth pump body; 28. fifth pump body;
29. constant-temperature water tank; 30. sixth pump body; 31. first on-off valve; 32. second on-off valve;
33. third on-off valve; 34. fourth on-off valve; 35. fifth on-off valve; 36. sixth on-off valve;
37. automatic water replenishment valve; 38. seventh on-off valve; 39. seventh pump body;
401. group A nozzle assembly; 402. group B nozzle assembly; 403. group C nozzle assembly;
501. group A cooling-type heat exchanger; 502. group B cooling-type heat exchanger; 503. group C cooling-type heat exchanger;

201. eighth on-off valve; 202. constant cryogenic liquid/gas tank;

203. eighth pump body; 204. ninth pump body; 205. ninth on-off valve.

DETAILED DESCRIPTION OF THE EMBODIMENTS

As shown in FIGS. 1 to 4, an air-circulating heat dissipation system for a low-vacuum tube train cools air in a low-vacuum tube through one or a combination of the following methods.

Scheme 1. Enhancing Air Flow Disturbance In the Low-Vacuum Tube

The system includes cavities provided at a periphery of a train 2. The cavities extend in parallel along an advancing direction of the train 2. When the train 2 moves forward, the air in the low-vacuum tube is pressed to circulate in the cavity and the tube. The circulating air takes away heat generated when the train moves. Component groups that provide power and resistance for the movement and stop of the train 2 are provided in the cavity close to the periphery of the train 2. In this scheme, the component groups include a component group 10 for providing power for the train and a brake component 7 provided under the train 2. The component group and the brake component are evenly provided on two sides of the train 2. The circulating air takes away the heat generated by the component group 10 providing power for the train and the brake component 7 when the train is working. In addition, the component group 10 providing power for the train may also be horizontally provided under the train 2 or provided in other ways. The brake component 7 providing resistance for the train may also be provided vertically on the two sides of the train 2 or provided in other ways.

In order to dissipate the heat generated by the component group 10 providing power for the train and the brake component 7, the cavities include first cavities 4. An inner side of the first cavity 4 close to the train 2 is provided with the component group 10 providing power for the train. The other side of the first cavity adopts a concrete structure or other supporting structure. In this scheme, there are two first cavities 4, which are located on the two sides of the train 2 respectively. When the train 2 moves forward, the air in the low-vacuum tube is pressed into the first cavity 4 through a first air vent 3 close to a train head. Then, the air flows from a component group 10 providing power for the train at the train head to a component group 10 providing power for the train at the rear of the train. Finally, the air flows out through the first air vent 3 at the rear of a train body, so as to take away the heat generated when the train is running.

Since there is pressed air at the front of the train 2, in order to increase the air intake of the first cavity 4, an upper end surface of the first cavity 4 is provided with a plurality of first air vents 3 along the advancing direction of the train 2. These first air vents 3 may be evenly arranged on the first cavity 4.

In order to dissipate the heat generated by the brake component 7 at the bottom of the train 2, the cavities further include a second cavity 5 provided at the bottom of the train 2. An upper end surface of the second cavity 5 is provided with the brake component 7. The other side of the second cavity 5 adopts a concrete structure or other supporting structure. The brake component 7 is provided with a plurality of second air vents 8 along the advancing direction of the train 2. When the train 2 moves forward, the air in the low-vacuum tube is pressed into the second cavity 5 through a second air vent 8 close to the train head to flow under the brake component 7. Then the air flows out through a second air vent 8 at the rear of the train body, thereby taking away the heat generated when the train is running.

In order to achieve the air circulation effect, two sides of the second cavity 5 are further provided with communicating pipes 12 which communicate the corresponding first cavities 4 on the two sides respectively. Specifically, the communicating pipes 12 are provided in a cross section of the train 2 in a length direction.

Scheme 2. Cooling By Using a Cooling Assembly 2.1. On the basis of Scheme 1, a group A cooling assembly is provided in the cavity.

Figure 3:
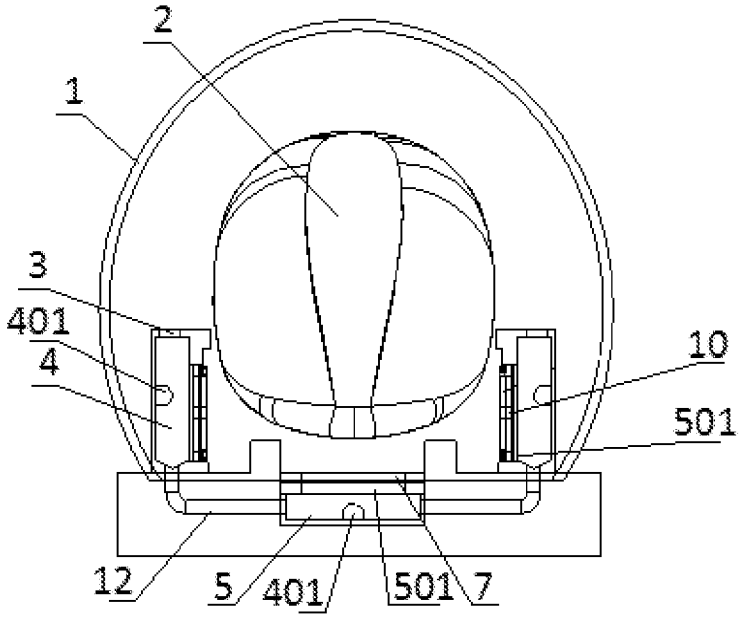
FIG. 3 is a cross-sectional view perpendicular to an advancing direction when a cavity is provided in the low-vacuum tube.
Figure 4:
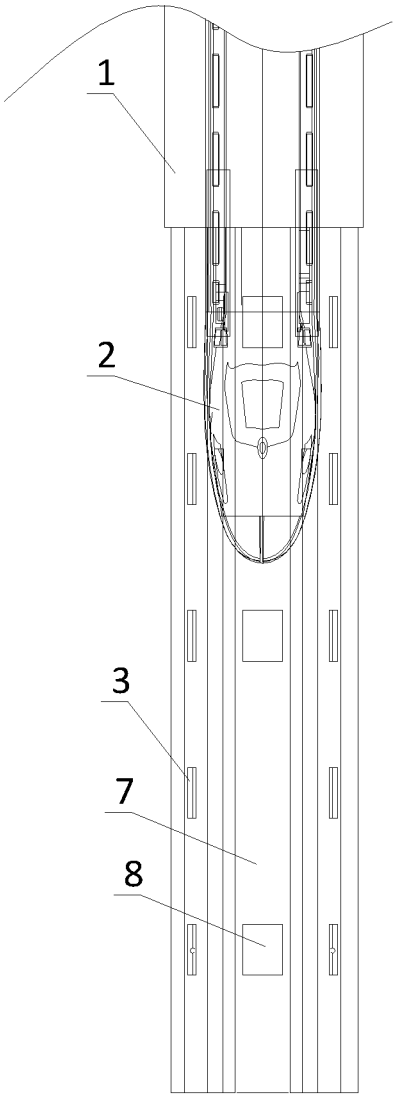
FIG. 4 is a cross-sectional view in a plan direction when a cavity is provided in the low-vacuum tube.

Specifically, the group A cooling assembly is provided in the first cavity 4 and the second cavity 5 respectively to cool the component group 10 providing power for the train and the brake component 7 in the low-vacuum tube. Referring to FIG. 3, a cooling-type heat exchanger or a plate-type heat exchanger and a nozzle assembly are provided in the cavity. As shown in FIG. 3, the group A cooling assembly includes a group A cooling-type heat exchanger 501 provided in the cavity and attached to the back of the component group and a group A nozzle assembly 401 spraying a cooling liquid against the back of the component group or the cavity. The direction of the group A nozzle assembly 401 may be automatically adjusted according to the internal temperature/pressure parameter of the low-vacuum tube. When the group A cooling-type heat exchanger is working, a circulating cryogenic liquid therein cools the air flowing through a surface of the group A cooling-type heat exchanger.

2.2. A group B cooling assembly is provided on an inner wall of the low-vacuum tube.

Figure 11:
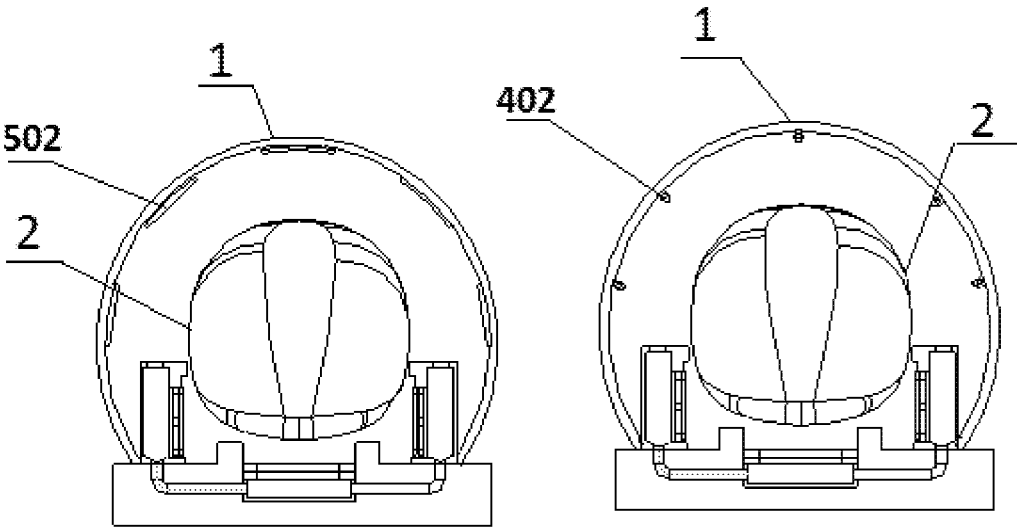
FIG. 11 is a cross-sectional view perpendicular to the advancing direction when the group B cooling assembly is provided on an inner side wall of the low-vacuum tube and a cavity is provided at the bottom.

The inner wall of the low-vacuum tube is provided with a cooling-type heat exchanger or a plate-type heat exchanger and a nozzle assembly. As shown in FIG. 11, the group B cooling assembly includes a group B nozzle assembly 402 and a group B cooling-type heat exchanger 502. The direction of the group B nozzle assembly 402 may be automatically adjusted according to the internal temperature/pressure parameter of the low-vacuum tube. The group B nozzle assembly 402 can spray a cooled liquid or gas onto a heating coil or a surface of the train along the line to absorb the heat in the low-vacuum tube 1 and on the surface of the train 2. Then the heated liquid or gas is pumped out of the low-vacuum tube 1 by a vacuum pump, thereby taking away the heat in the low-vacuum tube 1 and on the surface of the train 2. When the group B cooling-type heat exchanger is working, a circulating cryogenic liquid therein cools the air flowing through a surface of the group B cooling-type heat exchanger.

2.3. A group C cooling assembly is provided on an outer wall of the train 2.

Figure 2:
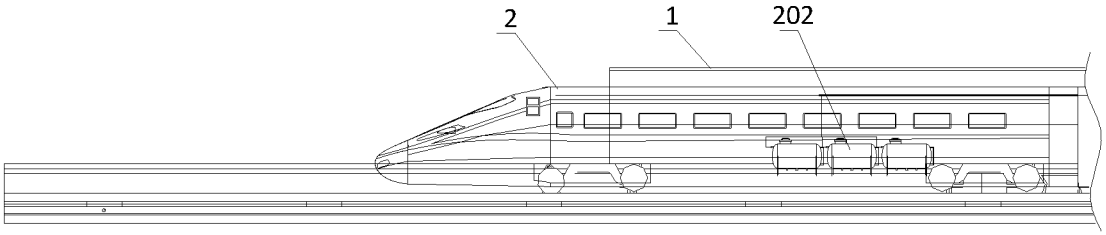
FIG. 2 is a side perspective view of the low-vacuum tube when a constant cryogenic liquid/gas tank is provided in the train.
Figure 12:
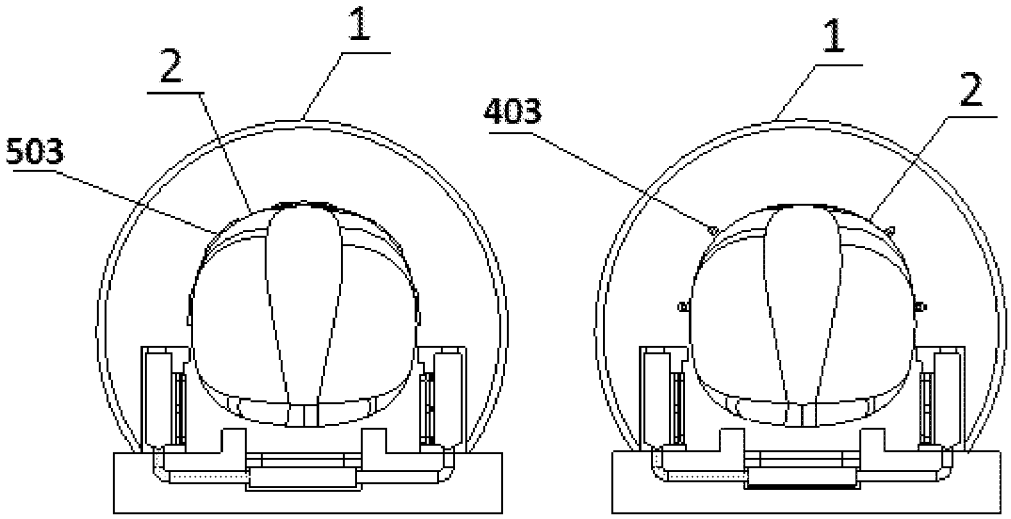
FIG. 12 is a cross-sectional view perpendicular to the advancing direction when a group C cooling assembly is provided on an outer side wall of the train and a cavity is provided at the bottom.
Figure 13:
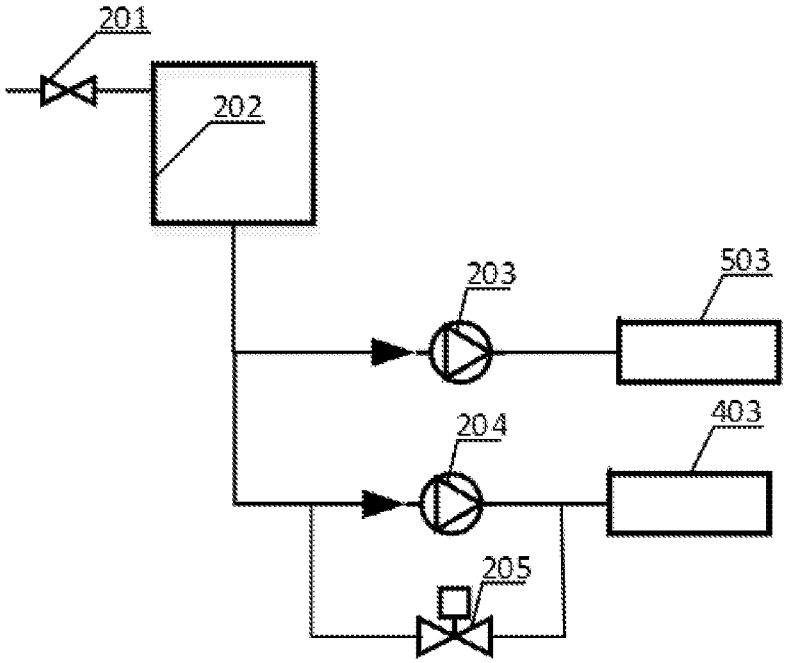
FIG. 13 shows a liquid/gas pipeline between the C group cooling assembly on the outer side wall of the train and the constant cryogenic liquid/gas tank in the train.

As shown in FIG. 12, the group C cooling assembly includes a group C cooling-type heat exchanger 503 and a group C nozzle assembly 403. As shown in FIG. 2, a constant cryogenic liquid/gas tank 202 is further provided in the train, and the group C nozzle assembly 403 is provided on the outer side wall of the train 2, as shown in FIG. 12. Circulating pipelines for supplying energy to the group C nozzle assembly 403 and the group C cooling-type heat exchanger 503 are shown in FIG. 13. An eighth pump body 203 is provided on a pipeline connecting the constant cryogenic liquid/gas tank 202 and the group C cooling-type heat exchanger 503. A ninth pump body 204 or a ninth on-off valve 205 is provided on a pipeline connecting the constant cryogenic liquid/gas tank 202 and the nozzle assembly 403. An input end of the constant cryogenic liquid/gas tank 202 is provided with an eighth on-off valve 201 for controlling the amount of the liquid/gas supplied into the constant cryogenic liquid/gas tank 202. In this scheme, the eighth on-off valve 201 is an automatic liquid/gas replenishment valve of the constant cryogenic liquid/gas tank.

The operation process is as follows:

1) The eighth pump body 203 is opened, and the working liquid/gas medium stored in the constant cryogenic liquid/gas tank 202 in a certain carriage of the train is transported to the group C cooling-type heat exchanger 503 on the outer side wall of the train through the corresponding circulating pipeline, so as to reduce the temperature outside the train.

2) The ninth pump body 204 is opened to transport the working liquid/gas medium stored in the constant cryogenic liquid/gas tank 202 in a certain carriage of the train to the group C nozzle assembly 403 through the corresponding circulating pipeline. Then the cryogenic working liquid/gas medium is sprayed into the low-vacuum tube to achieve cooling.

3) When the working liquid/gas medium in the constant cryogenic liquid/gas tank 202 is in a high-pressure state, if the train or system equipment exceeds an operating temperature range, only the ninth on-off valve 205 needs to be opened to supply the nozzle with the liquid/gas to achieve temperature regulation.

Figure 5:
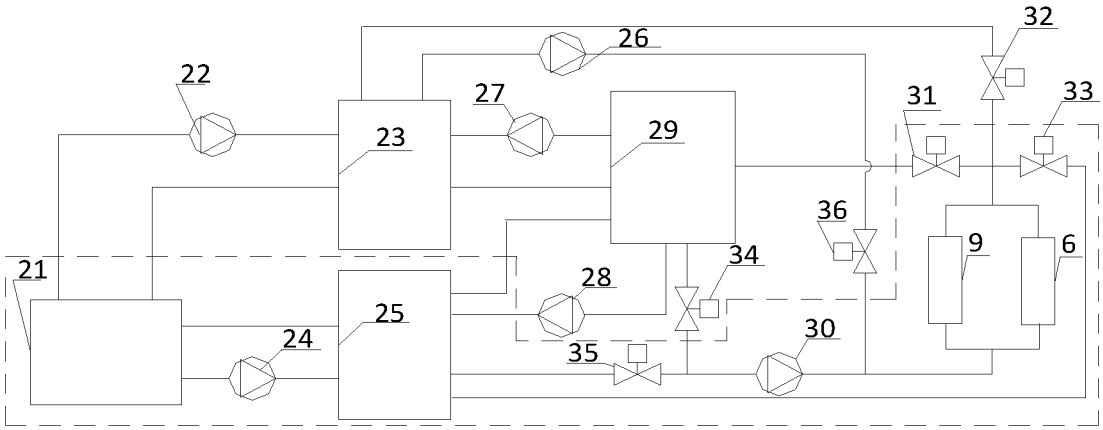
FIGS. 5 to 9 are structural diagrams of cooling-type heat exchangers at a cooling tower, a transition unit and a group A cooling assembly and/or a cooling-type heat exchanger at a group B cooling assembly in different modes.

In Schemes 2.1 and 2.2, the components connected to the cooling-type heat exchanger of the corresponding group and nozzle assembly may be arranged on the outer side of the low-vacuum tube 1. The layout design of each component includes Scheme A1, Scheme A2, Scheme A3 and Scheme A4. The specific structure is described as follows:

Scheme A1:

As shown in FIG. 5, the system includes a cooling tower 21 for providing a cold source for the cooling-type heat exchanger. A transition unit is further provided between the cooling tower 21 and the cooling-type heat exchanger. The transition unit includes a refrigeration unit 25. The cooling tower 21 and the refrigeration unit 25 form a heat exchange loop. A second pump body 24 is provided on a pipeline between the cooling tower 21 and a condensing end of the refrigeration unit 25. The cooling tower 21 provides cooling water of corresponding temperature for the condensing end of the refrigeration unit 25. A heat exchange loop is formed between the refrigeration unit 25 and several cooling-type heat exchangers. A sixth pump body 30 is provided on a pipeline of the refrigeration unit 25 for conveying the cooling medium. The refrigeration unit 25 may include various types of units such as a vapor compression cycle chiller, an absorption chiller, a compression condensing unit and an evaporator. An evaporating end of the refrigeration unit 25 can reduce the temperature of the heat exchange medium to a target low temperature. The cooled heat exchange medium flows back into the cooling-type heat exchanger to circulate. It can work repeatedly to realize uninterrupted cooling work. The group A cooling-type heat exchanger 501 and the group B cooling-type heat exchanger 502 may respectively include several first cooling-type heat exchangers 9 and second cooling-type heat exchangers 6 (as shown in FIGS. 5 to 10) arranged in parallel.

Figure 6:
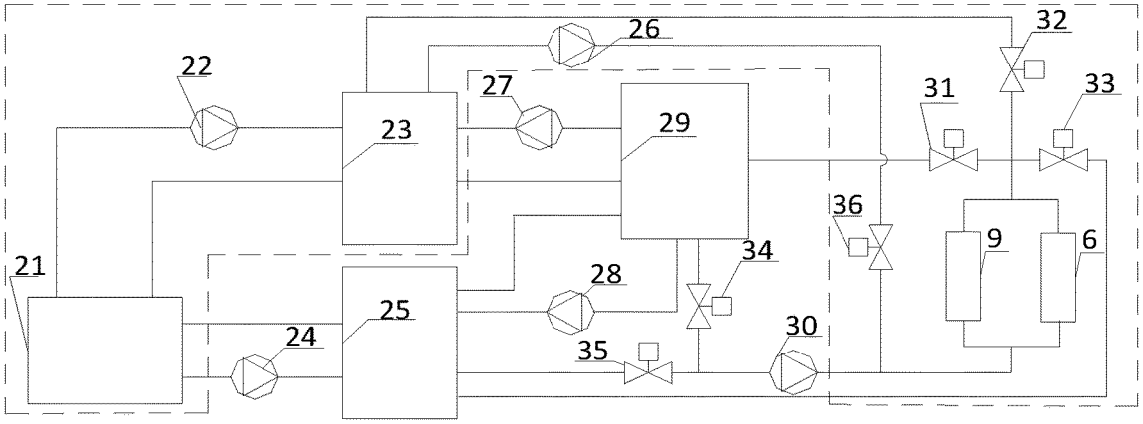

Scheme A2:

As shown in FIG. 6, the system includes a cooling tower 21 for providing a cold source for the cooling-type heat exchanger. A transition unit is further provided between the cooling tower 21 and the cooling-type heat exchanger. The transition unit includes a plate-type heat exchanger 23. The cooling tower 21 and the plate-type heat exchanger 23 form a heat exchange loop. A first pump body 22 is provided on a pipeline between the cooling tower 21 and a condensing end of the plate-type heat exchanger 23. A heat exchange loop is formed between the plate-type heat exchanger 23 and several cooling-type heat exchangers, and a third pump body 26 is provided on a pipeline of the plate-type heat exchanger 23 for conveying the cooling medium. The cooled heat exchange medium flows back into the cooling tower to circulate. It can work repeatedly to realize uninterrupted cooling work. This cold source supply mode does not require energy-consuming equipment such as the refrigeration unit to cool the heat exchange medium. On the contrary, it only relies on the cooling tower to achieve cooling via the plate-type heat exchanger 23 as a natural cold source. In this mode, the plate-type heat exchanger 23 is fully utilized to achieve energy-saving and emission-reduction operation.

Figure 7:
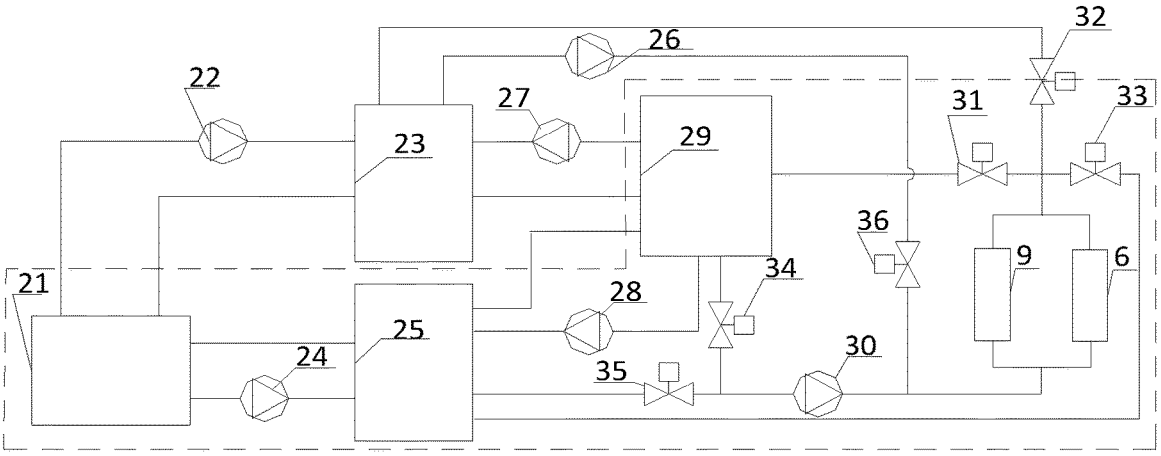

Scheme A3:

As shown in FIG. 7, a constant-temperature water tank 29 is provided between the refrigeration unit 25 of Scheme A1 and a plurality of parallel cooling-type heat exchangers. Specifically, the cooling tower 21 and the refrigeration unit 25 form a heat exchange loop. A second pump body 24 is provided on a pipeline between the cooling tower 21 and a condensing end of the refrigeration unit 25. A heat exchange loop is provided between the refrigeration unit 25 and the constant-temperature water tank 29. An evaporating end of the refrigeration unit can reduce the temperature of the heat exchange medium in the constant-temperature water tank to a target low temperature. A fifth pump body 28 is provided on a pipeline from the constant-temperature water tank 29 to the refrigeration unit 25. A heat exchange loop is formed between the constant-temperature water tank 29 and several cooling-type heat exchangers. A sixth pump body 30 is provided on a pipeline of the constant-temperature water tank 29 for conveying the cooling medium. This method is an indirect cooling method. The first cooling-type heat exchanger and the second cooling-type heat exchanger may use water or other heat exchange media with low electrical conductivity and high thermal conductivity for circulating flow.

Figure 8:
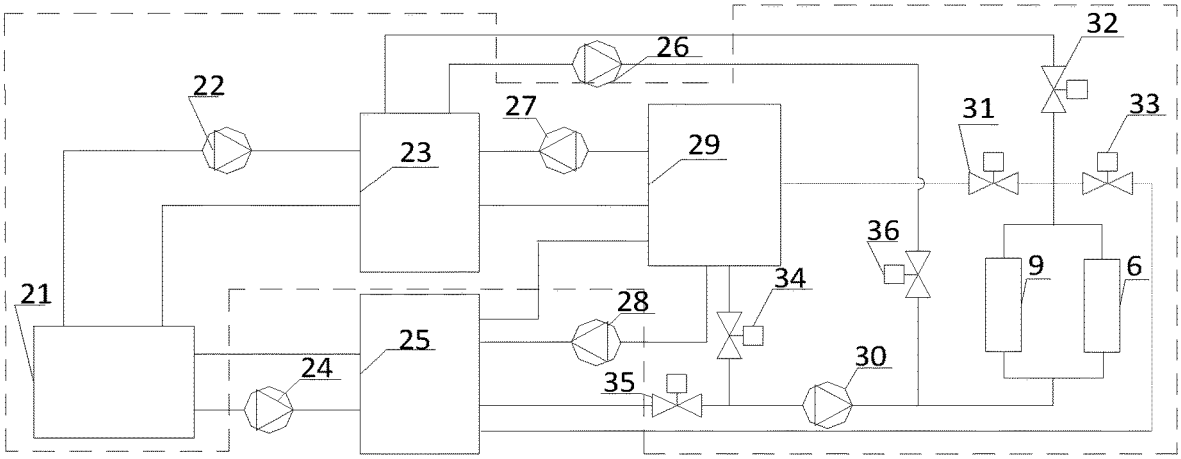

Scheme A4:

As shown in FIG. 8, a constant-temperature water tank 29 is provided between the plate-type heat exchanger 23 of Scheme A2 and a plurality of parallel cooling-type heat exchangers. Specifically, the cooling tower 21 and the plate-type heat exchanger 23 form a heat exchange loop. A first pump body 22 is provided on a pipeline between the cooling tower 21 and a condensing end of the plate-type heat exchanger 23. A heat exchange loop is provided between the plate-type heat exchanger 23 and the constant-temperature water tank 29. A fourth pump body 27 is provided on a pipeline from the constant-temperature water tank 29 to the plate-type heat exchanger 23. A heat exchange loop is formed between the constant-temperature water tank 29 and several cooling-type heat exchangers. A sixth pump body 30 is provided on a pipeline of the constant-temperature water tank 29 for conveying the cooling medium. The temperature of the heat exchange medium in the constant-temperature water tank 29 is reduced to a target low temperature by the cooling tower 21 through the plate-type heat exchanger 23. The treated heat exchange medium is transported to the first cooling-type heat exchanger 9 and the second cooling-type heat exchanger 6 in the system by a power device such as a pump. The first cooling-type heat exchanger 9 and the second cooling-type heat exchanger 6 are respectively composed of several group A cooling-type heat exchangers 501 and group B cooling-type heat exchangers 502 arranged in parallel. The heated heat exchange medium flows back into the constant-temperature water tank to circulate. It can work repeatedly to realize uninterrupted cooling work. This cold source supply mode does not require energy-consuming equipment such as the refrigeration unit to cool the heat exchange medium. On the contrary, it only relies on the cooling tower 21 to achieve cooling by using a natural cold source. In this mode, the natural cold source is fully utilized to achieve energy-saving and emission-reduction operation.

Figure 9:
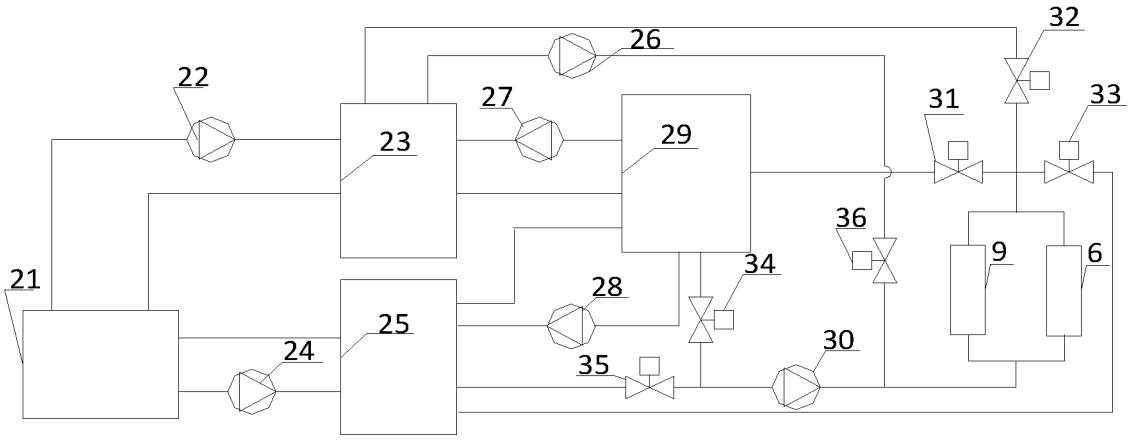

Scheme A5:

In order to achieve multiple choices under different conditions or implement the above multiple solutions at the same time, as shown in FIG. 9, the system includes a cooling tower 21 for providing a cold source for the cooling-type heat exchanger. A transition unit is further provided between the cooling tower 21 and the cooling-type heat exchanger. The transition unit includes a refrigeration unit 25, a plate-type heat exchanger 23, and a constant-temperature water tank 29.

The cooling tower 21 and the plate-type heat exchanger 23 form a heat exchange loop. A first pump body 22 is provided on a pipeline between the cooling tower 21 and a condensing end of the plate-type heat exchanger 23. The cooling tower 21 and the refrigeration unit 25 form a heat exchange loop. A second pump body 24 is provided on a pipeline between the cooling tower 21 and a condensing end of the refrigeration unit 25.

A heat exchange loop is formed between the plate-type heat exchanger 23 and several cooling-type heat exchangers. A third pump body 26 is provided on a pipeline of the plate-type heat exchanger 23 for conveying the cooling medium. A heat exchange loop is formed between the refrigeration unit 25 and several cooling-type heat exchangers. A sixth pump body 30 is provided on a pipeline of the refrigeration unit 25 for conveying the cooling medium.

A heat exchange loop is provided between the plate-type heat exchanger 23 and the constant-temperature water tank 29. A fourth pump body 27 is provided on a pipeline from the constant-temperature water tank 29 to the plate-type heat exchanger 23. A heat exchange loop is provided between the refrigeration unit 25 and the constant-temperature water tank 29. A fifth pump body 28 is provided on a pipeline from the constant-temperature water tank 29 to the refrigeration unit 25.

A heat exchange loop is formed between the constant-temperature water tank 29 and several cooling-type heat exchangers. A sixth pump body 30 is provided on a pipeline of the constant-temperature water tank 29 for conveying the cooling medium.

In order to realize the above multiple schemes, a first on-off valve 31 is provided on the pipeline for conveying the medium from the cooling-type heat exchanger to the constant-temperature water tank 29. A second on-off valve 32 is provided on the pipeline for conveying the medium from the cooling-type heat exchanger to the plate-type heat exchanger 23. A third on-off valve 33 is provided on the pipeline for conveying the medium from the cooling-type heat exchanger to the refrigeration unit 25. A fourth on-off valve 34 is provided on the pipeline for conveying the medium from the constant-temperature water tank 29 to the sixth pump body 30. A fifth on-off valve 35 is provided on the pipeline for conveying the medium from the refrigeration unit 25 to the sixth pump body 30. A sixth on-off valve 36 is provided on the pipeline for conveying the medium from the third pump body 26 to the cooling-type heat exchanger 6 and the cooling-type heat exchanger 9. All the above schemes can be selected by controlling the opening and closing states of the first on-off valve 31, the second on-off valve 32, the third on-off valve 33, the fourth on-off valve 34, the fifth on-off valve 35 and the sixth on-off valve 36.

To realize Scheme A1, it is necessary to open the third on-off valve 33 and the fifth on-off valve 35, close the first on-off valve 31, the second on-off valve 32, the fourth on-off valve 34 and the sixth on-off valve 36, and open the cooling tower 21, the refrigeration unit 25, the second pump body 24 and the sixth pump body 30.

To realize Scheme A2, it is necessary to open the second on-off valve 32 and the sixth on-off valve 36, close the first on-off valve 31, the third on-off valve 33, the fourth on-off valve 34 and the fifth on-off valve 35, and open the cooling tower 21, the plate-type heat exchanger 23, the first pump body 22 and the third pump body 26.

To realize Scheme A3, it is necessary to open the first on-off valve 31 and the fourth on-off valve 34, close the second on-off valve 32, the third on-off valve 33, the fifth on-off valve 35 and the sixth on-off valve 36, and open the cooling tower 21, the refrigeration unit 5, the second pump body 24, the fifth pump body 28 and the sixth pump body 30.

To realize Scheme A4, it is necessary to open the first on-off valve 31 and the fourth on-off valve 34, close the second on-off valve 32, the third on-off valve 33, the fifth on-off valve 35 and the sixth on-off valve 36, and open the cooling tower 21, the plate-type heat exchanger 23, the first pump body 22, the fourth pump body 27 and the sixth pump body 30.

Figure 10:
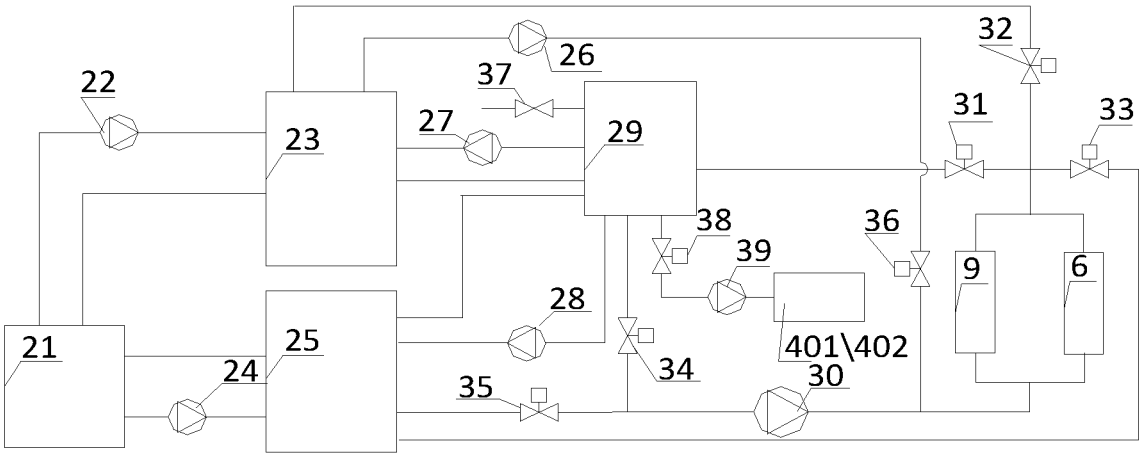
FIG. 10 is a structural diagram of the cooling tower and the transition unit in different modes when the group A cooling assembly and the group B cooling assembly are used.

As shown in FIG. 10, when Schemes 2.2 and 2.3 only use the nozzle assembly 401/402, the constant-temperature water tank 29 may be connected to an external water source through the automatic water replenishment valve 37. The constant-temperature water tank 29 includes an output end for supplying water to the nozzle assembly 401/402 by using the seventh on-off valve 38 and the seventh pump body 39 in sequence.

The train 2 runs in the low-vacuum tube 1, and the cavities in the air circulation system are all located in the low-vacuum tube 1. When the cooling assembly is provided in the cavity and/or on the inner side wall of the low-vacuum tube 1, in the above five schemes, the cooling tower 21 and the transition unit are provided in an area outside the line along the low-vacuum tube 1. This is because the cooling tower and the transition unit are not suitable for use in the low-vacuum environment.

Figure 14:
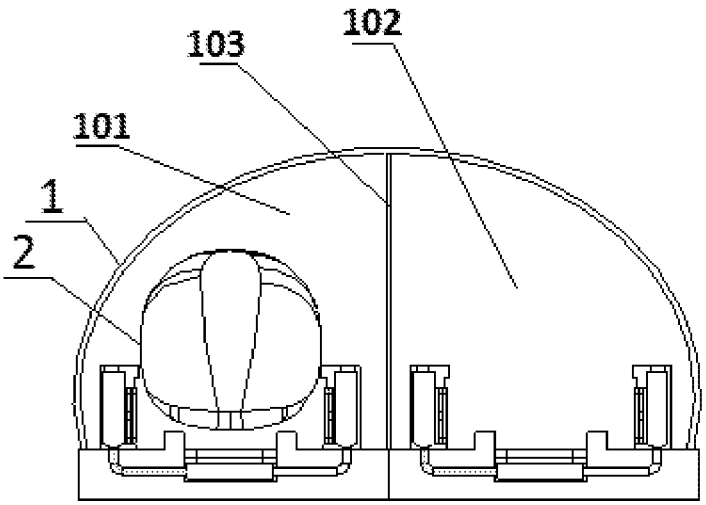
FIGS. 14 to 16 are structural diagrams showing dual rails in the low-vacuum tube.
Figure 15:
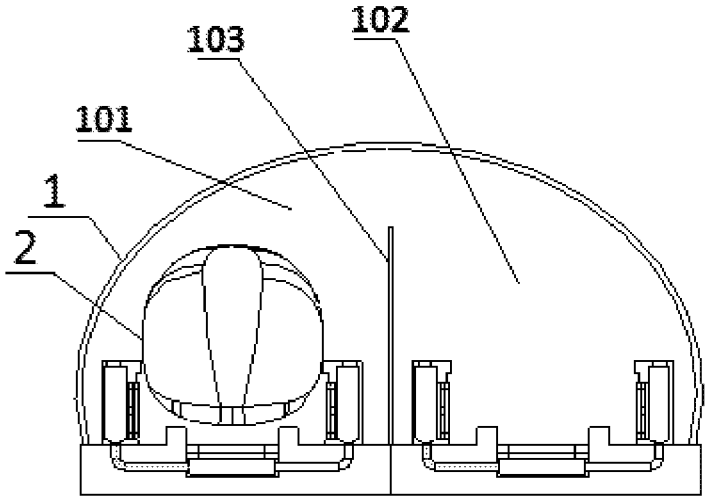
Figure 16:
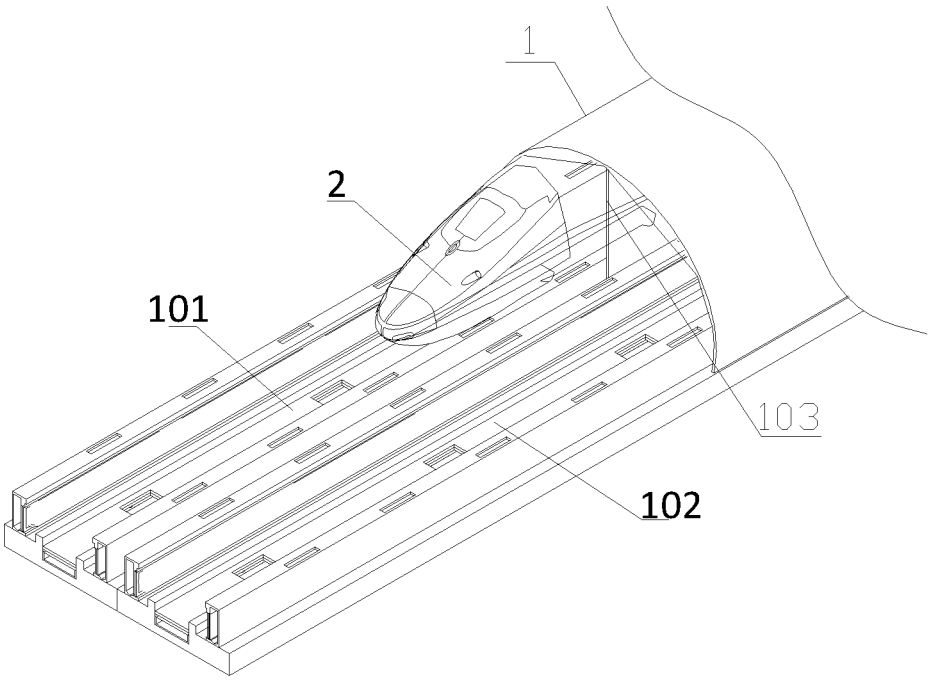

Since two trains travel in two directions, as shown in FIGS. 14 to 16, two groups of parallel cavities are arranged at the periphery of the corresponding train 2 in the low-vacuum tube 1. The low-vacuum tube 1 is divided into a first low-vacuum tube 101 and a second low-vacuum tube 102 by a partition 103.

In Scheme 1 and/or Scheme 2.1, a channel is excavated inside a concrete base at the bottom of the second cavity 5. The direction and specific dimensions of the channel may be designed according to needs. The channel may be filled with water or other liquid with low evaporation temperature. The liquid is fed into the channel by means of "flooding". The liquid is flowing, and it evaporates to cool the air flow inside the tube.

Scheme 1, Scheme 2.1, Scheme 2.2 and Scheme 2.3 may be used alone or in a combination. In addition, the layout design of the components connected to the cooling-type heat exchanger of the corresponding group and nozzle assembly in Schemes 2.1 and 2.2 may be selected from any one of Schemes A1, A2, A3 and A4.

The above described are merely preferred examples of the present disclosure, and are not intended to limit the present disclosure. Any modification, equivalent substitution and improvement without departing from the spirit and principle of the present disclosure should be included within the protection scope of the present disclosure.

What is claimed is:

1. A heat dissipation system for a high-speed train running in a vacuum tube, wherein in the vacuum tube, component groups, including a power source and a brake component, are disposed; each of the component groups is provided with a first cooling assembly; the first cooling assembly comprises a first cooling heat exchanger and/or a first nozzle assembly attached to a back of the component groups, wherein the vacuum tube further comprises cavities located at a periphery of the train; the cavities extend linearly along an advancing direction of the train; the component groups are provided in the cavities; the cavities are provided with air vents along a length direction of the cavities such that, when the train moves forward, air inside the vacuum tube is pressed to circulate in the cavities and the tube and the air takes away heat generated by the component groups when the train moves.

2. The heat dissipation system for the high-speed train running in the vacuum tube according to claim 1, wherein the vacuum tube is provided with a second cooling assembly; the second cooling assembly comprises a second cooling heat exchanger and/or a second nozzle assembly.

3. The heat dissipation system for the high-speed train running in the vacuum tube according to claim 1, wherein when the first cooling assembly comprises the first cooling heat exchanger, or the second cooling assembly comprises the second cooling heat exchanger, the first cooling assembly or the second cooling assembly further comprises a cooling tower for providing a cold source for the first cooling heat exchanger or the second cooling heat exchanger; a transition unit is further provided between the cooling tower and the first cooling heat exchanger or the second cooling heat exchanger; the cooling tower and the transition unit are provided outside the vacuum tube.

4. The heat dissipation system for the high-speed train running in the vacuum tube according to claim 3, wherein the transition unit comprises a plate heat exchanger or a refrigeration unit; a first heat exchange loop is formed between the plate heat exchanger or the refrigeration unit and the cooling tower; a second heat exchange loop is formed between the plate heat exchanger or the refrigeration unit and the first cooling heat exchanger or the second cooling heat exchanger.

5. The heat dissipation system for the high-speed train running in the vacuum tube according to claim 3, wherein the transition unit further comprises a constant-temperature water tank; the constant-temperature water tank is provided between the plate heat exchanger or the refrigeration unit and the first cooling heat exchanger or the second cooling heat exchange.

6. The heat dissipation system for the high-speed train running in the vacuum tube according to claim 2, wherein when the first cooling assembly comprises the first nozzle assembly, or the second cooling assembly comprises the second nozzle assembly, the first cooling assembly or the second cooling assembly further comprises a constant-temperature water tank, an automatic water replenishment valve, an on-off valve and a pump body; the constant-temperature water tank is connected to an external water source through the automatic water replenishment valve; the constant-temperature water tank comprises an output end for supplying water to the first nozzle assembly or the second nozzle assembly by using the on-off valve and the pump body in sequence.

7. The heat dissipation system for the high-speed train running in the vacuum tube according to claim 1, wherein the cavities comprise a first cavity provided at the periphery of the train and along a line in the vacuum tube.

8. The heat dissipation system for the high-speed train running in the vacuum tube according to claim 7, wherein an upper end surface of the first cavity is provided with a plurality of first air vents along the advancing direction of the train.

9. The heat dissipation system for the high-speed train running in the vacuum tube according to claim 8, wherein the cavities comprise a second cavity provided at a bottom of the train and along the line in the vacuum tube; an upper end surface of the second cavity is a brake component that is provided with a plurality of second air vents along the advancing direction of the train.

* * * * *